United States Patent [19]

Neese

[11] Patent Number: 4,583,681

[45] Date of Patent: Apr. 22, 1986

[54] EXTENSIBLE HANDLE CARTON WITH LEAKAGE PREVENTING FLAP STRUCTURE

[75] Inventor: Gerald W. Neese, Garden Grove, Calif.

[73] Assignee: Purex Corporation, Lakewood, Calif.

[21] Appl. No.: 648,588

[22] Filed: Sep. 10, 1984

[51] Int. Cl.[4] ..... B65D 5/46

[52] U.S. Cl. ..... 229/52 A; 229/39 R; 229/52 AC

[58] Field of Search ..... 229/52 A, 39 R, 52 AC; 206/200, 428

[56] References Cited

U.S. PATENT DOCUMENTS

| | | | |
|---|---|---|---|
| 3,074,613 | 1/1963 | Cupo | 229/39 R |
| 3,801,012 | 4/1974 | Thelen | 229/52 A |
| 4,286,714 | 9/1981 | Zdarsky et al. | 229/52 A |
| 4,347,970 | 9/1982 | Nardone | 229/39 R |

FOREIGN PATENT DOCUMENTS

| | | | |
|---|---|---|---|
| 642025 | 3/1935 | Fed. Rep. of Germany | 229/52 A |
| 3122339 | 12/1982 | Fed. Rep. of Germany | 229/52 B |
| 3209220 | 9/1983 | Fed. Rep. of Germany | 229/52 A |
| 2501635 | 9/1982 | France | 229/52 A |

*Primary Examiner*—William Price
*Assistant Examiner*—Gary E. Elkins
*Attorney, Agent, or Firm*—William W. Haefliger

[57] ABSTRACT

A carton has upright side walls, end walls, multiple inner flaps at the top of the carton, and an outermost flap at the carton top to cover the folded inner flaps. An elongated opening is provided through the outer flap, and a substantially flat strip handle extends at least partly in that opening and has opposite end portions retained to the outer flap and extending beneath same.

A substantially flat closure means closes the opening beneath said handle and isolates said handle from said inner flaps, the closure means including a first closure sheet underlying the opening and flatly attached to said outermost flap and supporting the handle end portions at the side of said first sheet furthest from the outermost flap. There are windows in the first closure sheet through which the handle passes. The closure means also includes a second and flexible closure sheet underlying the first closure sheet and attached thereto, so as to close the windows, the second closure sheet also covering the first closure sheet and retaining said handle end portions to the first closure sheet; and the first closure sheet also contains a slit extending between the windows, and beneath the major length of the handle, to enable downward deflection of the first closure sheet by finger pressure facilitating under grasping of the handle in stored position in said opening, the second closure sheet also covering the slit.

7 Claims, 5 Drawing Figures

EXTENSIBLE HANDLE CARTON WITH LEAKAGE PREVENTING FLAP STRUCTURE

BACKGROUND OF THE INVENTION

This invention relates generally to leakage of particulate from cartons, and more particularly to flap and handle construction associated with such cartons which also prevent such leakage. While the description will make reference to detergent particles in such cartons, other particles are also contemplated.

In the past, it was found that detergent paticulate tended to leak or sift from cartons via openings in end flaps which carried handles attached to the flap or flaps. This problem becomes acute when an opening or openings must be provided in such flaps to store collapsible handles, which must be grasped and pulled out from such openings.

SUMMARY OF THE INVENTION

It is a major object of the invention to provide a simple, effective solution to the above problem. Basically, the new and improved carton construction comprises:

(a) a carton having upright side walls and end walls, (b) multiple inner flaps attached to multiple of said walls proximate to upper ends thereof to fold downwardly toward closed substantially horizontal positions, for retention in said positions, with junctions between said inner flaps, (c) and an outer flap attached to one of said walls proximate the upper end thereof to fold downwardly toward closed, substantially horizontal position to cover said inner flaps in their downwardly folded position, and to cover said junctions between said inner flaps, (d) there being an elongated opening through said outer flap, (e) a substantially flat strip handle extending at least partly in said opening and having opposite end portions retained to said outer flap and extending beneath said outer flap, (f) and substantially flat closure means closing said opening beneath said handle and isolating said handle from said inner flaps.

Further, and as will appear, the closure means may include a first closure sheet directly underlying the opening in the outer flap and supporting handle end portions, there being windows in that sheet through which the handle extends, one window together with the opening in the outer flap sized to accomodate storage of a Z-folded portion of the handle; a second closure sheet underlying the first sheet and attached to same so as to close the windows to access of particulate shifting between interlocking junctions of the inner flaps, the second sheet also retaining the handle end portions to the first sheet; and provision for grasping of the stored handle including a slit located in the first closure sheet extending between the windows, as referred to.

These and other objects and advantages of the invention, as well as the details of an illustrative embodiment, will be more fully understood from the following specification and drawings, in which:

DRAWING DESCRIPTION

DETAILED DESCRIPTION

Figure 1:
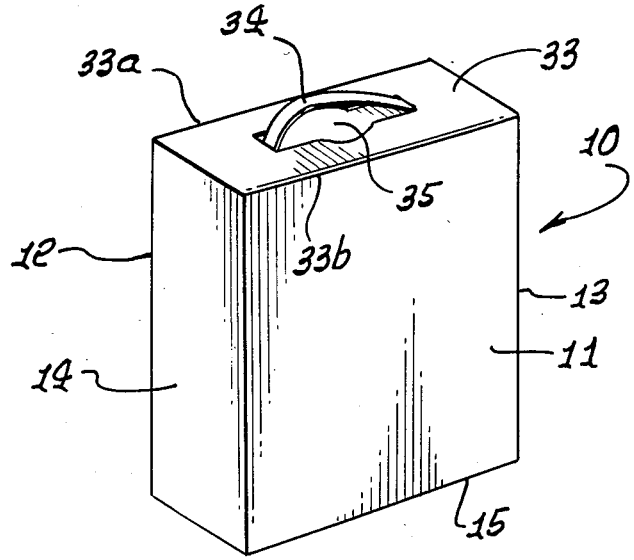
FIG. 1 is a perspective view of a carton, with attached pull-out handle.
Figure 2:
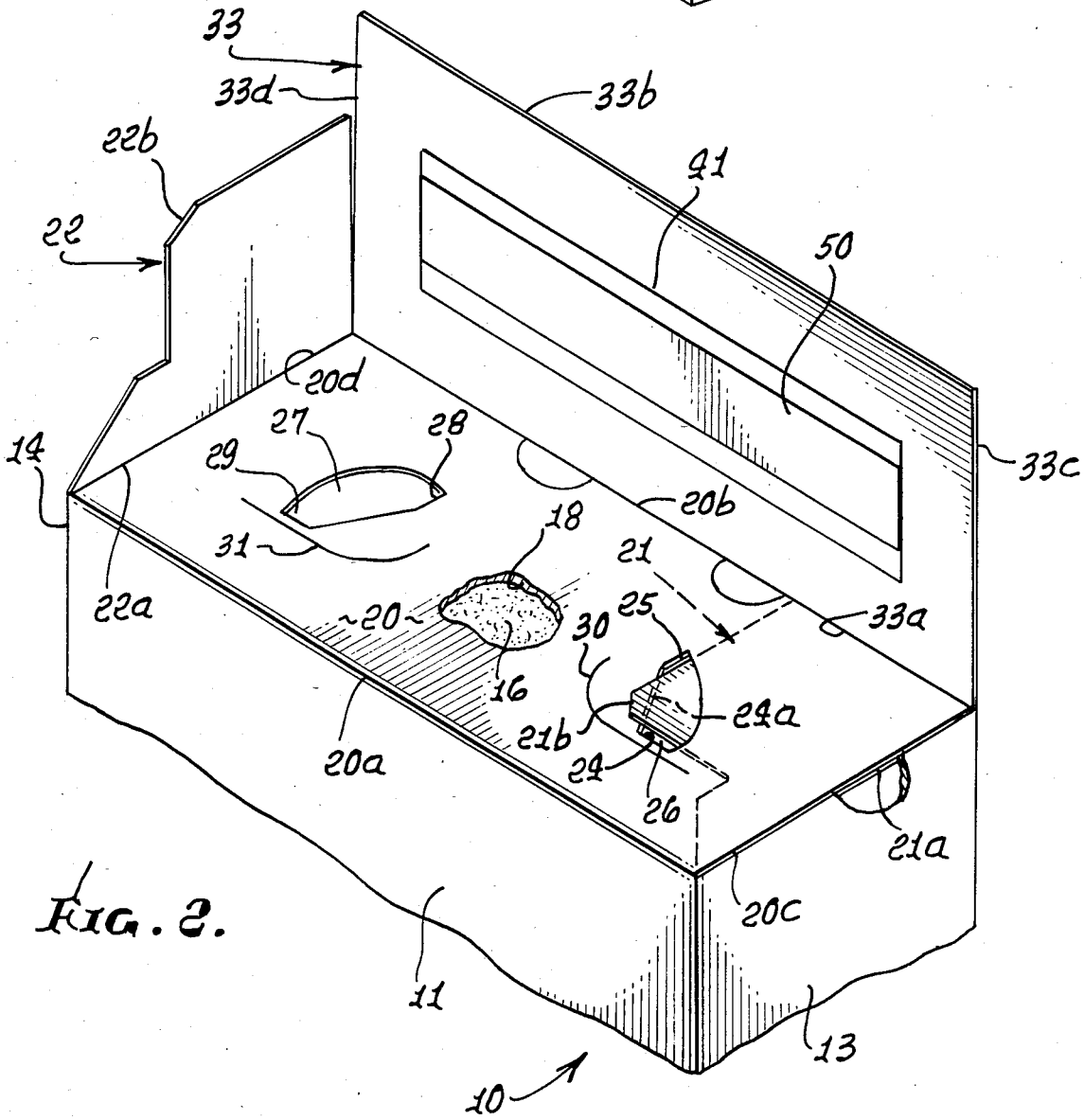
FIG. 2 is an enlarged perspective view of the FIG. 1 carton, showing inner and outer flap construction.
Figure 3:
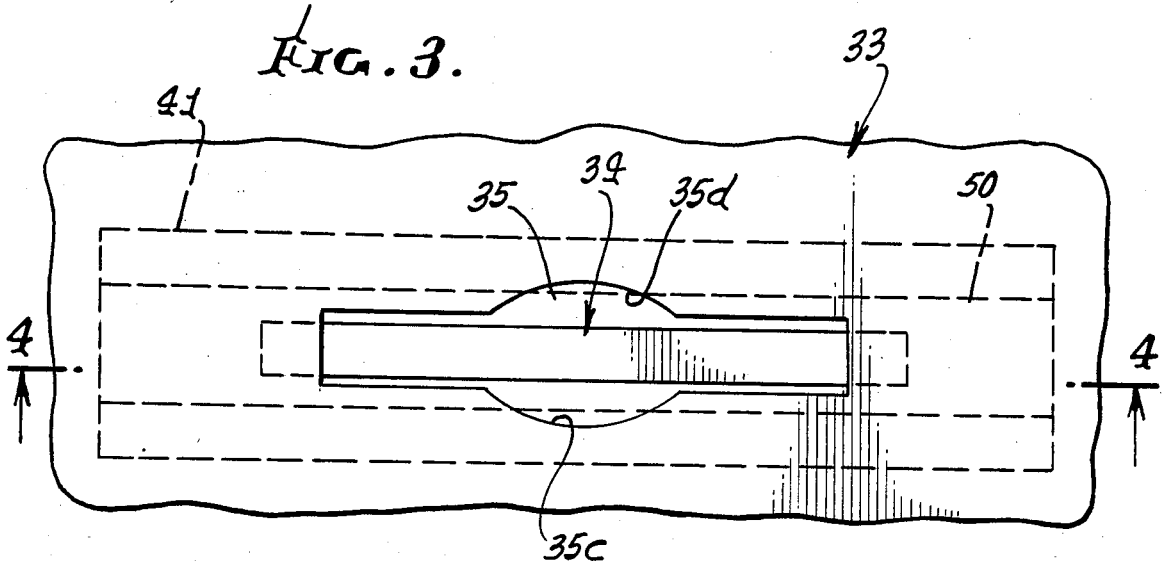
FIG. 3 is an enlarged plan view of the outer flap, when closed and showing the handle.

Referring first to FIGS. 1 and 2, a carton 10 typically of cardboard construction, has upright side walls 11 and 12 (i.e., front and back sides) and upright end walls 13 and 14, the carton being elongated between such end walls. The location of a bottom wall is indicated at 15. The carton may, for example contain flowable solid detergent particles (indicated for example at 16 below the broken away portion 18 of inner flap 20 in FIG. 2). Conventionally, there is a problem of such detergent product leaking or shifting through small openings formed at the top of the carton, when lift handles are employed.

As shown in FIGS. 2–5, multiple inner flaps are attached to multiple of the carton upright walls, and proximate the upper ends of such walls, to fold downwardly toward closed substantially horizontal positions, for retention in such positions, with junctions between such inner flaps. See for example major inner flap 20 attached along hinge 20*a* to side wall 11; minor inner flap 21 attached along hinge 21*a* to end wall 13; and similar minor inner flap 22 attached along hinge 22*a* to end wall 14. In FIG. 2, major inner flap 20 has been folded down to extend horizontally over the carton interior and it has peripheral edges indicated at 20*b*–20*d* proximate the tops of walls 12, 13 and 14. Minor inner flap 21 has also been folded down to extend horizontally generally beneath flap 20 and has a corner 21*b* extended adjacent and above a diagonal edge 24*a* of a cutout 24 in flap 20, for retention in down position. Cutout 24 is sized for ease of insertion of the corner 21*b* through the cut-out. Small gaps remain at junction locations 25 and 26 via which particulate in the carton can sift or leak outwardly. Minor inner flap 22 is shown in vertical position prior to down-folding along with flap 20 to the same position beneath major flap 20 as flap 21. Cut-out 27 is the same as cut-out 24, and located to pass the corner 22*b* of flap 22. Small gaps then remain at junction locations 28 and 29, the same as junctions 25 and 26, and via which detergent or other particulate can leak or sift. See also curved slits 30 and 31 in flap 20 which facilitate insertion of the flap corners 21*b* and 22*b* through the cut-outs, as described. Such slits also pose the problem of leakage of particulate therethrough.

An outer flap 33 is attached to one of the upright walls, proximate the upper end thereof, to fold downwardly toward closed, substantially horizontal position, to cover the inner flaps in their down-folded positions, and to cover the junctions between the inner flaps, as described. In this regard, the inner side of the outer flap may be glued to the upper sides of the inner flaps as for example along the borders bounded by folds 20*a*, 21*a* and 22*a*, to block lateral or horizontal escape of particulate. Flap 33 has fold edge 33*a*, and peripheral edges 33*b*–33*d* as shown, to extend proximate folds 20*a*, 21*a* and 22*a*.

Figure 4:
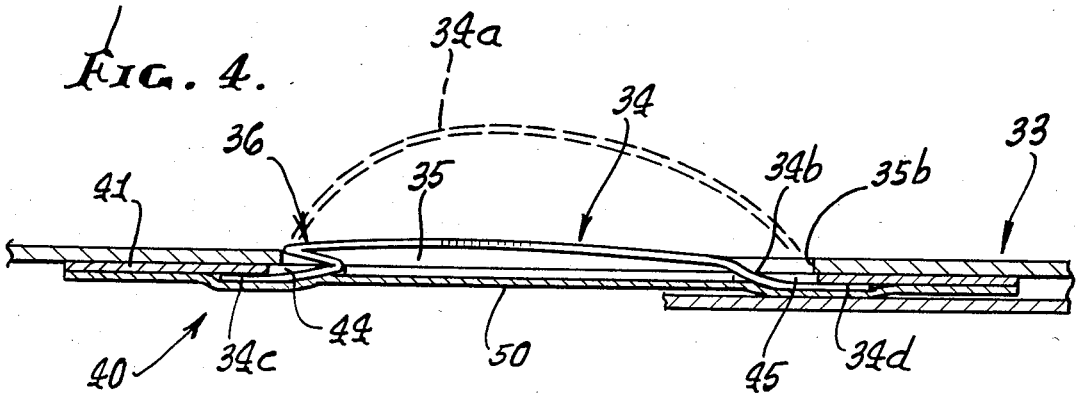
FIG. 4 is a section taken on lines 4—4 of FIG. 3.
Figure 5:
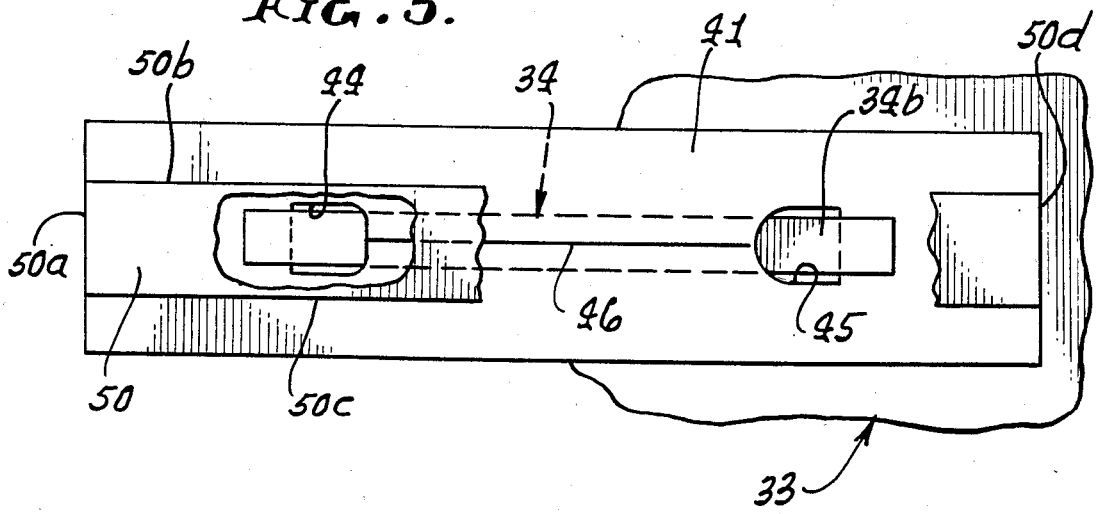
FIG. 5 is a bottom plan view of the outer flap, and showing a closure partly broken away.

To facilitate carriage of the carton, a handle 34 is provided to have a collapsed position, as indicated in FIG. 4, and an upwardly extended position indicated by broken lines 34*a* in FIG. 4, the handle typically consisting of a flat flexible strip of plastic material having sufficient tensile strength to support the filled carton. The handle in stored position (see FIG. 4) is associated with an opening 35 cut or formed in the outer flap 33, so as to at least partly extend in that opening, and may be completely pushed down in that opening so that cartons can be stably stacked on top of one another. Thus, the thickness of the handle strip is preferably substantially less than that of the outer flap, to enable such storage, with the handle preferably having a Z-folded portion at 36, which enables handle extension from collapsed position. Thus, a mid-portion of the handle between the Z-fold 36 and the opposite end 34*b* of the handle (near the end 35*b* of the opening 35) is extensible upwardly, from stored position in opening 35. The latter may be laterally enlarged as at curved concave edges 35*c* and 35*d* to enable finger access to opposite edges of the handles, and finger and thumb access to the underside of the handle in stored position in opening 35.

To prevent outward leakage or sifting of the carton contents (which have sifted through junctures 25, 26, 28, 29 etc.) into the space directly below the outer flap, and out through opening 35, the handle is isolated from that space by provision of substantially flat closure means closing opening 35 beneath the handle, the closure at the same time facilitating strong retention of the handle ends to the inner side of the outer flap. In the example shown, the flat closure means, generally indicated at 40 includes a first closure sheet 41, which may consist of strong relatively stiff paper or plastic material, directly underlying the opening 35 and attached as by gluing to the inner side of the flap 33, all around that opening 35. Also, sheet 41 may support the handle end portions 34*c* and 34*b* as by suitable bonding or adhesive retention to the inner side of sheet 41, to prevent shear failure therebetween under tension loading exerted by weight of the filled carton transmitted to the hand-held and extended handle. Windows 44 and 45 cut in the sheet 41 respectively receive or pass the handle Z-fold 36 and the handle end portion 34*b*, as shown; the window 44 in particular cooperating with opening 35 to assure complete storage (in down position) of the three Z-folded portions of the collapsed handle. A lengthwise slit 46 between the windows and in sheet 41 facilitates some downward deflection of the split sheet portions below the handle in response to downward finger pressure applied during grasping of the handle.

To prevent outward shifting of detergent or other particulate via windows 44 and 45, and slit 46, a second closure sheet 50 is provided to underlie the first closure sheet and cover the windows 44, 45 and slit 46, the second sheet bonded to the first sheet rectangularly about those apertures, to block access of particulate thereto. Thus, sheet 50 may be bonded to sheet 41 near the edges of sheet 50, indicated for example at 50*a*–50*d* in FIG. 5. Sheet 50 may consist of paper and be quite flexible.

Accordingly, a sturdy, simple, effective means to completely prevent escape of particulate is provided in a carton structure employing interlocked inner flaps as described, and a pull-out handle which is stored below the outer surface plane of the outer flap.

I claim:

1. A carton construction comprising, in combination:

(a) the carton having upright side walls and end walls, (b) multiple inner flaps attached to multiple of said walls proximate the upper ends thereof to fold downwardly toward closed substantially horizontal positions, for retention in said positions, with junctions between said inner flaps, (c) and an outermost flap attached to one of said walls proximate the upper end thereof to fold downwardly toward closed, substantially horizontal position to cover said inner flaps in their downwardly folded positions, and to cover said junctions between said inner flaps, (d) there being an elongated opening through said outermost flap, (e) a substantially flat strip handle extending at least partly in said opening and having opposite end portions retained in said outer flap and extending beneath said outer flap, (f) and a substantially flat closure means closing said opening beneath said handle and isolating said handle from said inner flaps, (g) said substantially flat closure means including a first closure sheet underlying said opening and flatly attached to said outermost flap and supporting the handle end portions at the side of said first sheet furthest from the outermost flap, there being windows in said first closure sheet through which the handle passes, (h) said substantially flat closure means also including a second and flexible closure sheet underlying the first closure sheet and attached thereto, so as to close said windows, said second closure sheet also covering the first closure sheet and retaining said handle end portions to the first closure sheet.

(i) said first closure sheet containing a slit extending between said windows, and beneath the major length of the handle, to enable downward deflection of said first closure sheet by finger pressure facilitating under grasping of the handle in stored position in said opening, said second closure sheet also covering said slit.

2. The combination of claim 1 wherein said handle has a folded portion extending at least partly in said opening above said closure, whereby a mid-portion of the handle is extensible upwardly to the exterior of the outer flap upon tensioned unfolding of said folded portion.

3. The combination of claim 1 wherein said first closure sheet is stiffer than said second closure sheet at regions in registration with said openings, the second sheet consisting of flexible paper,

4. The combination of claim 1 wherein the handle has a Z-folded portion extending in one of said windows and also in said opening.

5. The combination of claim 1 wherein the windows are in registration with opposite ends of said opening.

6. The combination of claim 1 wherein said inner flaps have interlocking relation.

7. The combination of claim 1 including flowable solid particle detergent in said carton.

* * * * *